US008887339B2

(12) United States Patent
Barzel

(10) Patent No.: US 8,887,339 B2
(45) Date of Patent: Nov. 18, 2014

(54) TOOTHBRUSH WITH MOVABLE BRISTLES SETS

(76) Inventor: Moshe Barzel, Beit Shemesh (IL)

( * ) Notice: Subject to any disclaimer, the term of this patent is extended or adjusted under 35 U.S.C. 154(b) by 17 days.

(21) Appl. No.: 13/595,180

(22) Filed: Aug. 27, 2012

(65) Prior Publication Data

US 2014/0053357 A1 Feb. 27, 2014

(51) Int. Cl.
*A46B 7/06* (2006.01)
*A46B 9/04* (2006.01)

(52) U.S. Cl.
USPC ..... 15/22.1; 15/167.1; 15/201

(58) Field of Classification Search
USPC ..... 15/22.1, 167.1, 201
See application file for complete search history.

(56) References Cited

U.S. PATENT DOCUMENTS 1,688,581 A 10/1928 Glassman
2,244,098 A * 6/1941 Busick ..... 15/172
2,254,365 A 9/1941 Griffith
2,429,437 A 10/1947 Walker
2,533,108 A 5/1950 Donald
3,559,226 A 2/1971 Burns
4,053,959 A 10/1977 Wiley
4,847,937 A 7/1989 Gorski
6,182,321 B1 2/2001 Wu
6,345,405 B1 2/2002 Brackin
6,357,073 B1 * 3/2002 Yue ..... 15/167.1
8,499,402 B1 * 8/2013 Arsenault ..... 15/167.1
2006/0179593 A1 8/2006 Okamura

* cited by examiner

*Primary Examiner* — Randall Chin
(74) *Attorney, Agent, or Firm* — Browdy and Neimark, PLLC

(57) ABSTRACT

A toothbrush including a handle, a head and a moving mechanism, where the head includes a head base; and at least two bristles sets: two outer bristles sets and a middle bristles set located therebetween. The moving mechanism connects to the two outer bristles sets for rotating thereof in respect to a main axis of the toothbrush for shifting the bristle sets between at least two positions: an open position, in which the outer bristles sets are angularly shifted away from the main axis; and a closed position, in which the outer bristles sets not angularly shifted away from the main axis, wherein in the closed position the bristles of all bristles sets are more dense than in the other positions providing a substantially harder toothbrush thereby allowing a user to change hardness level of the toothbrush by changing the position of the outer bristles sets.

20 Claims, 4 Drawing Sheets

TOOTHBRUSH WITH MOVABLE BRISTLES SETS

FIELD OF THE INVENTION

The present invention generally relates to toothbrushes and more particularly to toothbrushes having movable bristles sets.

BACKGROUND OF THE INVENTION

Many designs for toothbrushes are available today using a variety of handle and bristles materials. Most toothbrushes have either soft bristles for people with sensitive gums or harder bristles for enhancing cleansing efficiency.

SUMMARY OF THE INVENTION

According to one aspect of the invention, there is provided a toothbrush comprising a handle, a head and a moving mechanism. The head includes a head base; and at least two bristles sets: two outer bristles sets and a middle bristles set located therebetween. The moving mechanism connects to the two outer bristles sets for rotating thereof in respect to a main axis of the toothbrush for shifting the bristle sets between at least two positions: a first position ad a second position, wherein in the second position the bristles of all bristles sets are more dense than in the first position thereby allowing a user to change hardness level of the toothbrush by changing the position of the outer bristles sets.

Optionally, the moving mechanism enables shifting the bristle sets between three positions: a neutral position in which the outer bristles sets are substantially parallel to the middle bristles set and to one another; the open position, in which the outer bristles sets are angularly shifted away from the main axis; and the closed position, in which the outer bristles sets are angularly shifted towards the main axis.

Additionally or alternatively, the outer bristles sets comprise softer bristles than the bristles of the middle bristles set.

Optionally, the moving mechanism allows shifting between the at least two positions in a discrete manner, where the respective outer bristles set can be discretely positioned at optional angles in respect to the main axis.

Additionally or alternatively, the moving mechanism comprises: (i) a main shaft; (ii) a mechanical switch connected to the main shaft for rotating thereof for switching between positions; (iii) two axles each configured for rotating a different the outer bristles set; and (iv) at least one spring configured for pushing the axles inwardly and outwardly towards and away for the main axis according to the positioning of the mechanical switch, wherein the spring is operatively connected to the main shaft, which is rotatable by the mechanical switch for contracting and retracting of the spring for shifting between the at least two discrete positions.

The head base may optionally be made of an elastic material for bending in response to forces applied over the head when a user brushes his/her teeth using the toothbrush.

Additionally or alternatively, in the open position, the angle between each outer bristles set and the main axis is between 20-30 degrees.

According to some embodiments, the moving mechanism comprises an electronic switch, configured to allow electronic switching between positions.

Additionally or alternatively, the toothbrush further includes an electric motor system configured for moving at least one of the bristles sets in rotational movements.

According to some embodiments, the bristles of each outer bristles set include an angular tip facing the main axis and the bristles of the middle bristles set are straight.

DETAILED DESCRIPTION OF THE INVENTION

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a novel toothbrush having movable bristles for enabling a user to change configuration of the toothbrush according to his/her brushing requirements in a manner that will effectively cleanse his/her teeth. The toothbrush includes a handle, which can be ergonomically designed, a toothbrush head including three sets of bristles: two outer bristles sets and a single middle bristles set located therebetween, and a moving mechanism for rotating the outer bristles sets for changing the configuration of the toothbrush head and thereby changing its hardness level, design and the like.

The moving mechanism may be configured to discretely change the configuration of the toothbrush head between three optional positions: a neutral position, in which all the bristles of all the bristles sets are substantially parallel to one another; an open position in which the two outer bristles sets are tilted away from a main axis of the toothbrush forming an angle between their bristles and the bristles of the middle bristles set; and a closed position in which the bristles of the outer bristles sets are tilted inwardly towards the main axis of the toothbrush forming a much denser bristles configuration creating thereby a toothbrush of a substantially higher hardness level.

According to some embodiments of the invention, the outer bristles sets may include much softer bristles than those of the middle bristles set. In this way, once brushing in sensitive areas such as receding gums area the outer bristles sets are the ones that reach the gum-line due to the tilting of the entire head for brushing the sides of the teeth and therefore only the softer part of the head brushes these areas. This may require the user to mechanically or electronically shift the position of the toothbrush head for brushing each area in his/her mouth, where for example, to brush less sensitive areas such as the occlusal teeth surfaces.

Figure 1C:
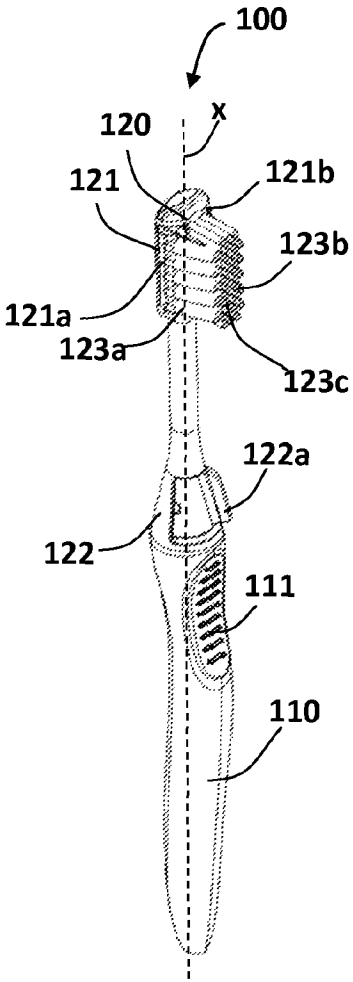
FIG. 1C shows the toothbrush with movable bristles, according to the same embodiment of the invention, in a closed position.
Figure 1B:
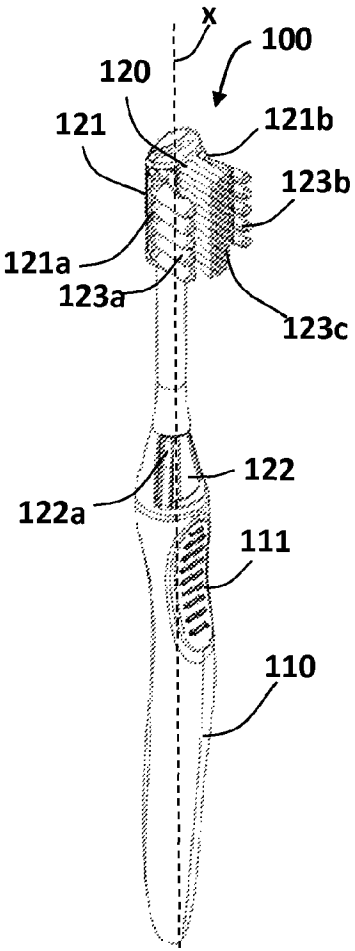
FIG. 1B shows the toothbrush with movable bristles, according to the same embodiment of the invention, in an open position.
Figure 1A:
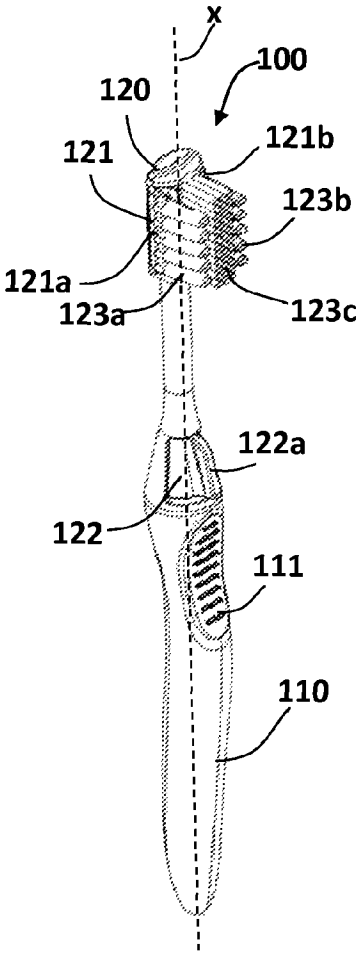
FIG. 1A shows a toothbrush with movable bristles, according to one embodiment of the invention, in a neutral position.
Figure 2:
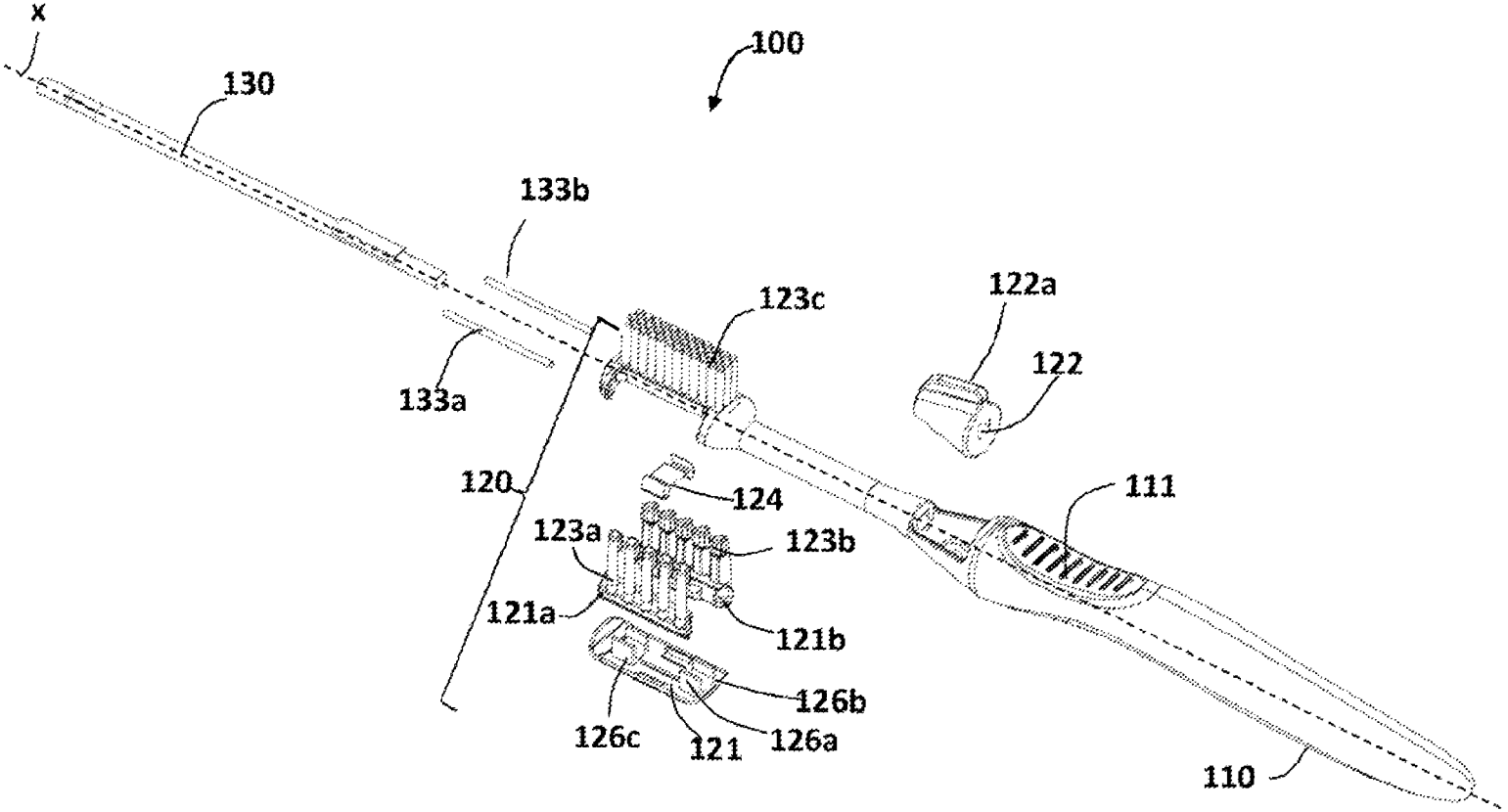
FIG. 2 shows an exploded view of the toothbrush, according to the same embodiment of the invention.

Reference is now made to FIGS. 1A-1B and FIG. 2, schematically illustrating a toothbrush 100 with movable bristles, according to one embodiment of the present invention. The toothbrush 100 includes an ergonomic handle 110 having a thumb depression 111, toothbrush head 120 (also simply referred to as head), and a moving mechanism integrated in the head 120 and handle 110 of the toothbrush 100.

The moving mechanism includes three bristles sets: two outer bristle sets 123*a* and 123*b* and a middle bristles set 123*c* located therebetween. The middle bristles set 123*c* fixedly connects to the handle 110 while the outer bristles sets 123*a* and 123*b* pivotally connect to a head base 121 via tubular holders 121*a* and 121*b* respectively for rotating to switch between: (i) a neutral position, in which all bristles sets 123*a*-123*c* are substantially parallel to one another, as shown in FIG. 1A; (ii) an open position, in which the outer bristles sets 123*a*-123*b* are titled outwardly in respect to a main axis "x" of the toothbrush 100, as shown in FIG. 1B; and (iii) a closed position, in which the outer bristles sets 123*a*-123*b* are titled inwardly in respect to the main axis "x" of the toothbrush 100, as shown in FIG. 1C.

According to some embodiments, as illustrated in FIG. 2, the moving mechanism includes; (i) a main shaft 130 connected to (ii) a mechanical switch 122 having an ergonomic protrusion 122*a* for allowing the user to rotate the mechanical switch 122 for shifting between the three optional positions: neutral, open or closed; two axles 133*a*-133*b* each for being inserted through a respective tubular holder 121*a*/121*b* for rotating thereof; (iii) the head base 121 configured for holding both outer bristles sets 123*a* and 123*b* through (iv) a spring 124 (better shown in FIG. 3).

Figure 3:
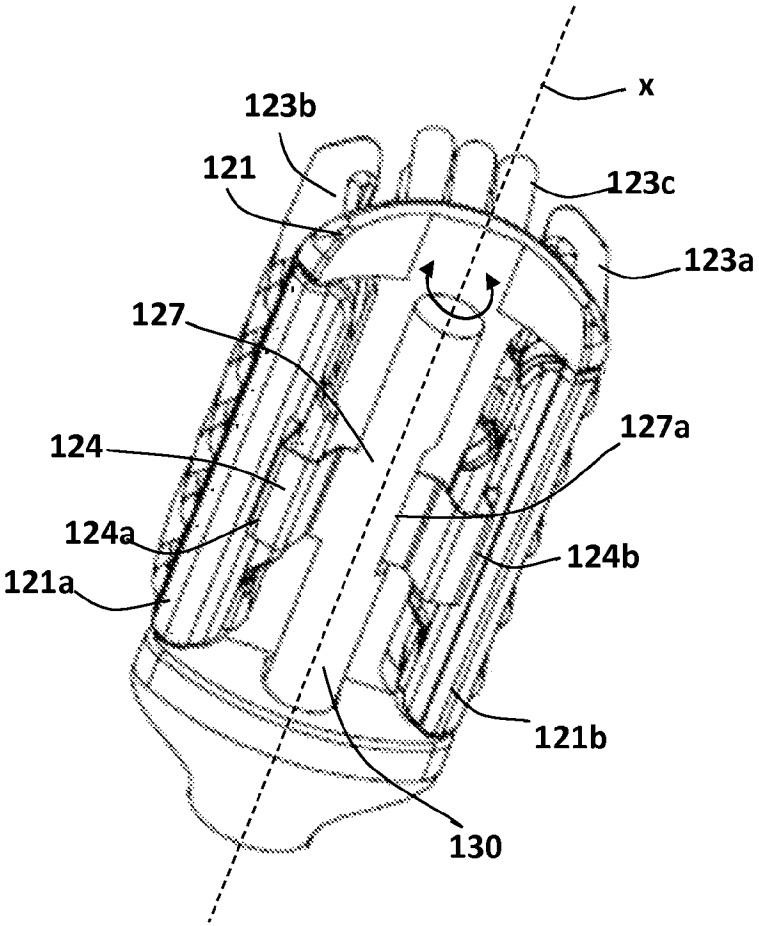
FIG. 3 shows a part of the toothbrush head base including a spring fastened thereby for moving the bristles thereof, according to the same embodiment of the invention as illustrated in FIGS. 1A-2.

The main shaft 130 defining the main axis "x", is held by the head base 121 via two holders 126*a*-126*b* and a holding member 126*c*. The main shaft 130 is also inserted through an opening at the mechanical switch 122. The spring 124 is held by the head base 121 as illustrated in FIG. 3, such that once the main shaft 130 is rotated by rotating of the mechanical switch 122, it rotates the head base 121 and thereby rotates the spring 124 to tilt, contract or retract thereof for switching to the desired position of.

The spring 124 allows forcing the tubular holders 121*a* and 121*b* to rotate inwardly or outwardly in respect to the main axis "x" and thereby rotate the bristles sets 123*a* and 123*b* connected thereto. FIG. 3 shows how the head base 121 includes a fastening mechanism 127 including a designated opening 127*a* for holding the spring 124 that is designed as a bridge shaped flexible material (optionally metal or polymeric material) having holding members 124*a* and 124*b* that can grab onto the tubular holders 121*a* and 121*b*, respectively, for rotating thereof. Since the spring 124 is held by the head base 121 fastening mechanism 127, in a manner that also holds the main shaft 130, rotation of the shaft 130 causes the spring 124 to contract, stretch or retract to a stable neutral position thereof, depending on the rotational direction and aperture (arch defining how much the main shaft 130 has been rotated and to which direction) of the main shaft 130. For example, the neutral position of the spring 124 will result in a neutral position of the head 120 (by holding the outer bristles sets 123*a* and 123*b* in a parallel state); an arched position of the spring 124 in which its middle section bends away from the head base 121, will result in the closed position, in which the outer bristles sets 123*a* and 123*b* are facing the middle bristles set 123*c* (titled towards axis "x"); and a sagging-concave position of the spring 124 will cause the open position of the head 120 in which the outer bristles sets 123*a* and 123*b* are tilted outwardly.

It is also clear from FIGS. 1A-1C that the closed position is a position in which the surface of the head 120 is the smallest and the largest in the open position.

Figure 4:
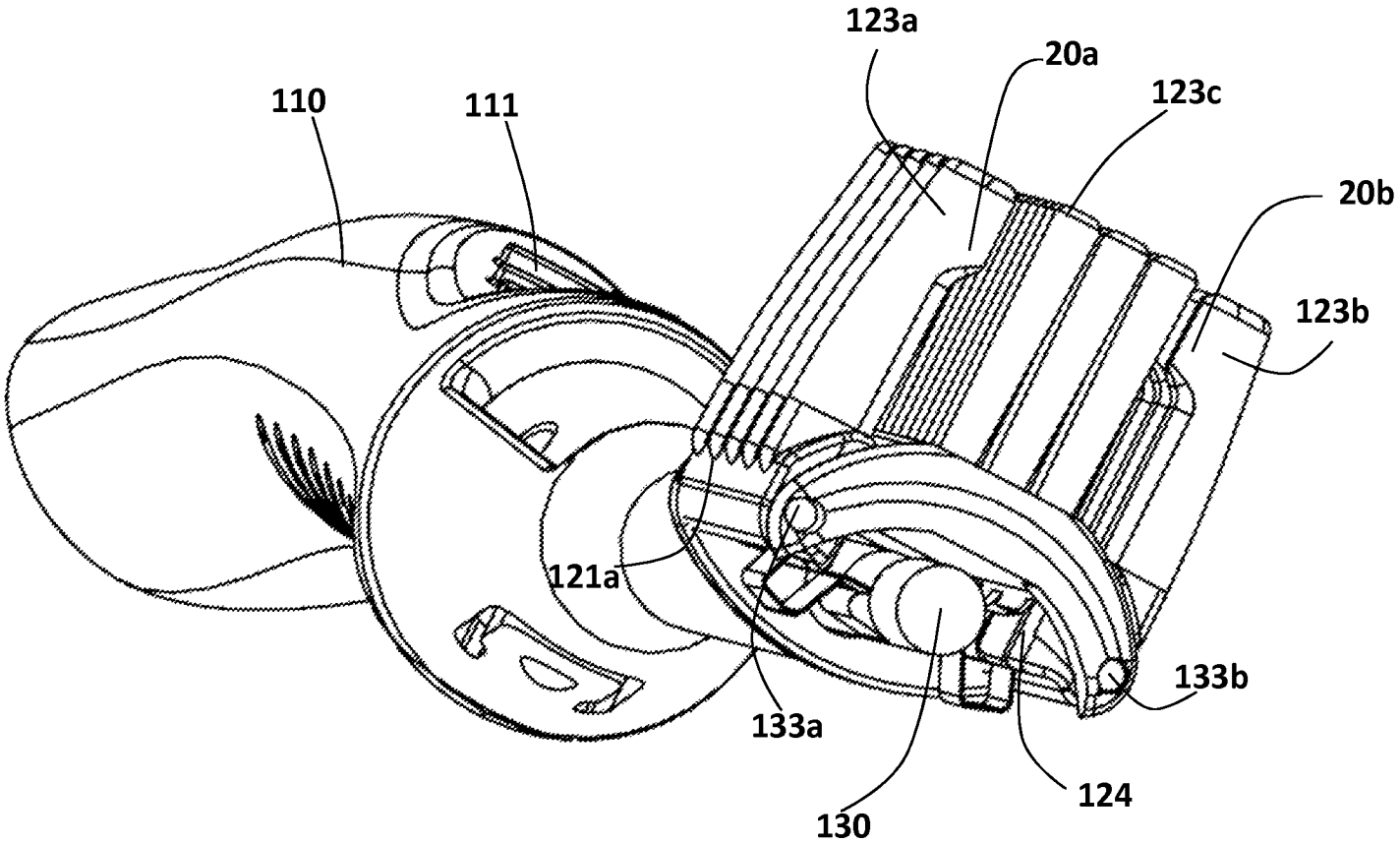
FIG. 4 shows an upper section of the toothbrush in an isometric perspective.

FIG. 4 shows how the outer bristles sets 123*a* and 123*b* can optionally include bristles having angular tips 20*a* and 20*b* facing the main axis "x" while the bristles of the middle bristles set 123*c* are straight.

According to some embodiments of the invention, the bristles of the outer bristles sets 123*a*-123*b* are much softer than the bristles of the middle bristles set 123*c*. In this configuration, the user may shift the toothbrush 100 to its open position for brushing sensitive areas such as areas in which the user has receding gums for (i) allowing the bristles of the outer bristles sets 123*a* and/or 123*b* to reach the gum-line as well as to (ii) allow gentle brushing in those sensitive areas. When brushing less sensitive areas such as the occlusal teeth surfaces area, the user can shift the toothbrush 100 to a closed position to enhance brushing effect—since in this position the bristles of all sets 123*a*-123*c* are much denser and harder improving cleansing properties of the toothbrush 100 or alternatively use the neutral position if there is some sensitivity there. The neutral position may also be used for areas in which no gum sensitivity is felt by the user but when the brushing area is still near the gum-line.

According to some embodiments of the invention, the head base 121 may include specially designed recesses or holes that improve cleaning of the toothbrush 100 after it is used thereby improving preservation thereof.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

What is claimed is:

1. A toothbrush comprising:

a) a handle;

b) a head comprising:

(i) a head base; and (ii) at least three bristles sets: two outer bristles sets and a middle bristles set located therebetween;

c) a moving mechanism which connects to the two outer bristles sets for rotating the outer bristles sets in respect to a main axis, between at least two optional positions: a first opened position and a second closed position in respect to a main axis of the toothbrush, wherein in the second position the bristles of all bristles sets are more dense than in the first position thereby allowing a user to change hardness level of the toothbrush by changing the position of said outer bristles sets, wherein said moving mechanism comprises at least two axles, each axle being configured for attaching to bristles of a different outer bristles set, each said axle is rotatable for changing position of bristles of each of said outer bristles set between the first position and the second position.

2. The toothbrush according to claim 1, wherein said moving mechanism enables shifting the bristle sets between three positions: a neutral position in which the outer bristles sets are substantially parallel to the middle bristles set and to one another; the open position, in which the outer bristles sets are angularly shifted away from said main axis; and the closed position, in which the outer bristles sets are angularly shifted towards said main axis.

3. The toothbrush according to claim 1, wherein said outer bristles sets comprise softer bristles than the bristles of said middle bristles set.

4. The toothbrush according to claim 1, wherein said moving mechanism allows shifting between said at least two optional positions in a discrete manner, where the respective outer bristles set can be discretely positioned at optional angles in respect to said main axis according to one of said at least positions thereof.

5. The toothbrush according to claim 1, wherein said moving mechanism comprises:

(i) a main shaft;

(ii) a mechanical switch connected to said main shaft for rotating thereof for mechanically switching between said at least two discrete positions; and (iii) at least one spring configured for pushing said axles inwardly and outwardly towards and away for the main axis according to the positioning of said mechanical switch, said spring is operatively connected to said main shaft, which is rotatable by said mechanical switch for contracting and retracting of said spring for shifting said toothbrush between said at least two positions.

6. The toothbrush according to claim 5, wherein said head base is made of an elastic material for bending in response to forces applied over said head when a user brushes his/her teeth using said toothbrush.

7. The toothbrush according to claim 1, wherein in said first position the angle between each outer bristles set and said main axis is between 20-30 degrees.

8. The toothbrush according to claim 1, wherein said moving mechanism comprises an electronic switch, configured to allow electronic switching between optional two switch positions of said bristles sets.

9. The toothbrush according to claim 1 further comprising an electric motor system configured for moving at least one of said bristles sets in rotational movements.

10. The toothbrush according to claim 1, wherein the bristles of each outer bristles set comprise an angular tip facing said main axis and the bristles of said middle bristles set are straight.

11. A toothbrush comprising:

a) a handle;

b) a head comprising:

(i) a head base; and (ii) at least three bristles sets: two outer bristles sets and a middle bristles set located therebetween;

c) a moving mechanism which connects to the two outer bristles sets for rotating thereof in respect to a main axis of the toothbrush for shifting the bristle sets between at least two optional positions: a first open position and a second closed position, wherein in the second position the bristles of all bristles sets are more dense than in the first position thereby allowing a user to change hardness level of the toothbrush by changing the position of said outer bristles sets, and wherein said moving mechanism enables shifting the bristle sets between three positions: a neutral position in which the outer bristles sets are substantially parallel to the middle bristles set and to one another; the second closed position, in which the outer bristles sets are angularly shifted away from said main axis; and the first open position, in which the outer bristles sets are angularly shifted towards said main axis.

12. The toothbrush according to claim 11, wherein said outer bristles sets comprise softer bristles than the bristles of said middle bristles set.

13. The toothbrush according to claim 11, wherein said moving mechanism allows shifting between said at least two optional positions in a discrete manner, where the respective outer bristles set can be discretely positioned at optional angles in respect to said main axis according to one of said at least two positions thereof.

14. The toothbrush according to claim 11, wherein said moving mechanism comprises:

a main shaft;

a mechanical switch connected to said main shaft for rotating thereof for mechanically switching between said at least two positions;

two axles each configured for rotating a different said outer bristles set; and at least one spring configured for pushing said axles inwardly and outwardly towards and away for the main axis according to the positioning of said mechanical switch, said spring is operatively connected to said main shaft, which is rotatable by said mechanical switch for contracting and retracting of said spring for shifting said toothbrush between said at least two positions.

15. The toothbrush according to claim 14, wherein said head base is made of an elastic material for bending in response to forces applied over said head when a user brushes his/her teeth using said toothbrush.

16. The toothbrush according to claim 11, wherein in said first position the angle between each outer bristles set and said main axis is between 20-30 degrees.

17. The toothbrush according to claim 11, wherein said moving mechanism comprises an electronic switch, configured to allow electronic switching between the optional two switch positions of the bristles sets.

18. The toothbrush according to claim 11 further comprising an electric motor system configured for moving at least one of said bristles sets in rotational movements.

19. The toothbrush according to claim 11, wherein the bristles of each outer bristles set comprise an angular tip facing said main axis and the bristles of said middle bristles set are straight.

20. A toothbrush comprising:

a) a handle;

b) a head comprising:

(i) a head base; and (ii) at least three bristles sets: two outer bristles sets and a middle bristles set located therebetween;

c) a moving mechanism which connects to the two outer bristles sets for rotating thereof in respect to a main axis of the toothbrush for shifting the bristle sets between at least two positions: a first position and a second position, wherein in the second position the bristles of all bristles sets are more dense than in the first position thereby allowing a user to change hardness level of the toothbrush by changing the position of said outer bristles sets, and wherein the bristles of each outer bristles set comprise an angular tip facing said main axis and the bristles of said middle bristles set are straight.

* * * * *